US008667755B1

(12) United States Patent
Finfrock et al.

(10) Patent No.: US 8,667,755 B1
(45) Date of Patent: Mar. 11, 2014

(54) DUAL PANEL COMPOSITE TRUSS APPARATUS

(71) Applicants: Robert D Finfrock, Orlando, FL (US); Allen R Finfrock, Maitland, FL (US); Daniel Finfrock, Orlando, FL (US); Donald Booker, Fernandina Beach, FL (US)

(72) Inventors: Robert D Finfrock, Orlando, FL (US); Allen R Finfrock, Maitland, FL (US); Daniel Finfrock, Orlando, FL (US); Donald Booker, Fernandina Beach, FL (US)

(73) Assignee: Finfrock Industries, Inc., Apopka, FL (US)

( * ) Notice: Subject to any disclaimer, the term of this patent is extended or adjusted under 35 U.S.C. 154(b) by 0 days.

(21) Appl. No.: 13/826,425

(22) Filed: Mar. 14, 2013

(51) Int. Cl.
*E04B 1/18* (2006.01)

(52) U.S. Cl.
USPC ..... 52/414; 52/790.1

(58) Field of Classification Search
USPC ..... 52/414, 426, 431–433, 783.1, 790.1, 52/690, 693, 479, 442, 565, 378, 428, 52/649.1, 649.8
See application file for complete search history.

(56) References Cited

U.S. PATENT DOCUMENTS

| | | | | |
|---|---|---|---|---|
| 4,125,981 | A * | 11/1978 | MacLeod et al. | 52/309.12 |
| 5,398,470 | A * | 3/1995 | Ritter et al. | 52/309.11 |
| 6,000,194 | A * | 12/1999 | Nakamura | 52/783.17 |
| 7,571,576 | B2 * | 8/2009 | Pruitt | 52/250 |
| 7,891,150 | B2 | 2/2011 | Finfrock et al. | |

* cited by examiner

*Primary Examiner* — Jeanette E Chapman
*Assistant Examiner* — Daniel Kenny
(74) *Attorney, Agent, or Firm* — William M. Hobby, III

(57) ABSTRACT

This invention relates to a dual panel composite truss having a pair of spaced apart prestressed concrete panels having a versatile and adaptive structurally supporting end bearing truss on the ends thereof. The end bearing truss incorporates a versatile and adaptive structural support on each end of the composite truss. The end bearing truss is formed as an integral part of the composite truss for supporting the ends of the composite truss when the composite truss is used for the floors or ceiling of a building. The end bearing truss advantageously forms each end of each concrete panel form for the concrete pour when making each concrete panel.

25 Claims, 3 Drawing Sheets

DUAL PANEL COMPOSITE TRUSS APPARATUS

FIELD OF THE INVENTION

This invention is related to a dual panel composite truss having a pair of spaced apart concrete panels and especially to a dual panel composite truss having a versatile and adaptive structurally supporting end bearing truss on the ends thereof for supporting the composite truss.

BACKGROUND OF THE INVENTION

Prefabricated double wall concrete components have been used in the past to construct building walls. Such wall members may include a plurality of welded wire spacing frames to retain the slabs of the wall member in a spaced apart configuration. Typically, the welded wire spacing frames provide limited structural reinforcement of the wall member. It has been proposed to use such prefabricated wall members as structural flooring and/or roofing members. However, a dual slab member designed as a wall may not be readily adaptable to a floor or roofing application due to different loading forces on the member. For example, a wall member used in a floor application may have a limited span distance due to the minimum structural capacity provided by the welded wire spacing frames. More robust welded steel trusses having upper and lower longitudinal portions embedded in respective upper and lower slabs have been proposed as a framing structure for a composite truss that can span up to 60 feet and greater. However, welding and/or other structural attachment techniques used to manufacture such framing structures significantly adds to the cost and time needed to manufacture the trusses and thereby increases the cost of the composite truss.

This invention is an improvement of prior U.S. Pat. No. 7,891,150 for a Composite Truss by Robert D. Finfrock and Allen R. Finfrock, the contents of which prior U.S. Patent is incorporated herein by reference in its entirety. In this prior patent a composite truss has a pair of spaced apart prestressed concrete panels and a plurality of substantially vertical members spanning between the pair of spaced apart concrete panels, one end portion of each vertical member being embedded in one of the spaced apart concrete panels and the opposite end being imbedded in the other concrete panel. The truss includes a diagonal member spanning between the one end of a vertical member and the other end of an adjacent vertical member. Each end of the diagonal member non-structurally engages an end of a vertical member. Each diagonal member also has a length thereof embedded in the concrete in each spaced apart concrete panel. Each end of the composite truss has a prefabricated concrete end bearing beam for supporting the end of the composite truss.

This invention relates to a dual panel composite truss having a pair of spaced apart and generally parallel prestressed concrete panels having a structurally supporting end bearing truss on each end thereof. The end bearing steel truss incorporates a versatile and adaptive structural support capabilities on each end of the composite truss which advantageously forms each end of each concrete panel mold when the concrete is poured to form the panels.

SUMMARY OF THE INVENTION

This invention relates to a composite truss, for use in a building floor or ceiling, having a main truss having a pair of spaced apart prestressed concrete panels spaced by a plurality of vertical members. Each end of each vertical member is embedded in opposite spaced concrete panels. The main truss has a plurality of diagonal members each extending between the concrete embedded end of one vertical member in one of the pair of spaced concrete panels to the other end of an adjacent concrete embedded vertical member embedding in the other of the pair of spaced concrete panels. An improved end bearing truss has a plurality of end members aligned along one end of the composite truss with each end member having two end portions and each end member having one end portion thereof embedded in one concrete panel and the other end portion thereof embedded in the other concrete panel. The end bearing truss has a plurality of diagonal truss members, each diagonal truss member having a diagonal portion with a generally horizontal end extension. The diagonal portion of each diagonal truss member is fixedly attached to one end of one end member, with the horizontal extension embedded in one of the concrete panels. Each one of a plurality of elongated rod anchors is fixedly attached to the end portion of one end member and is embedded in one of the concrete panels. A transverse extending flat plate is fixedly attached, such as by welding, to one end of the aligned end members adjacent one of the concrete panels and may have an elongated supporting flange attached thereto at a generally right angle thereto. The transverse extending flat plate may have additional rod anchors fixedly attached thereto and extending therefrom into the adjacent concrete panel. The transverse extending flat plate may advantageously become the end of the form for pouring one concrete panel. A dual panel composite truss thus has a load supporting end bearing truss integrally formed thereinto which is a versatile and adaptive structural support. An elongated flat plate may be mounted to the other end portion of each end member and may have a plurality of rod anchors extending therefrom into the adjacent concrete panel. The elongated flat plate may advantageously become the end of the form for pouring the other concrete panel.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

In the drawings.

DETAILED DESCRIPTION OF EXEMPLARY EMBODIMENT

Figure 1:
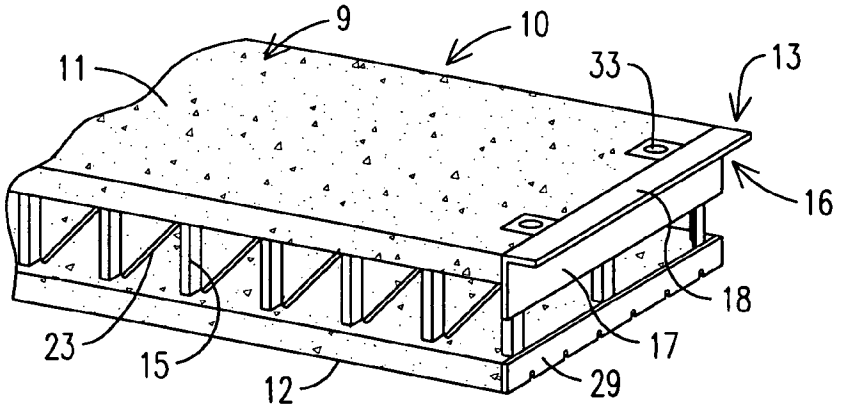
FIG. 1 is a partial perspective of a dual panel composite truss in accordance with the present invention.

This invention relates to dual panel composite truss 10 having a main truss portions 9 with an end bearing truss 13 forming an integral part thereof in FIG. 1. The main truss portion has a pair of spaced apart and generally parallel concrete panels 11 and 12 having an improved structurally supporting end bearing truss 13 on the ends thereof. The end bearing truss 13, which may be made of steel, has improved structural support on the end of the composite truss 10 for supporting the composite truss to enhance the strength and versatility of the end of the composite truss 10.

Referring to FIGS. 1 through 7, the composite truss 10 has a pair of panels 11 and 12 spaced by a plurality of substantially vertical members 14 and diagonal members 19 spanning between the pair of spaced apart concrete panels. One end portion of each vertical and diagonal member is embedded in one spaced apart concrete panels with the opposite end being embedded in the other concrete panel. The diagonal member 19 spans between the one end of each vertical member 14 and the other end of an adjacent vertical member. Each end of the diagonal member non-structurally engages an end of a vertical member. Each diagonal member also has a length thereof embedded in the concrete in each spaced apart concrete panel. Each end of the composite truss previously had a prefabricated concrete end bearing beam for supporting the end of the composite truss. The composite truss is more fully described in our prior U.S. Pat. No. 7,891,150 for a Composite Truss.

Figure 2:
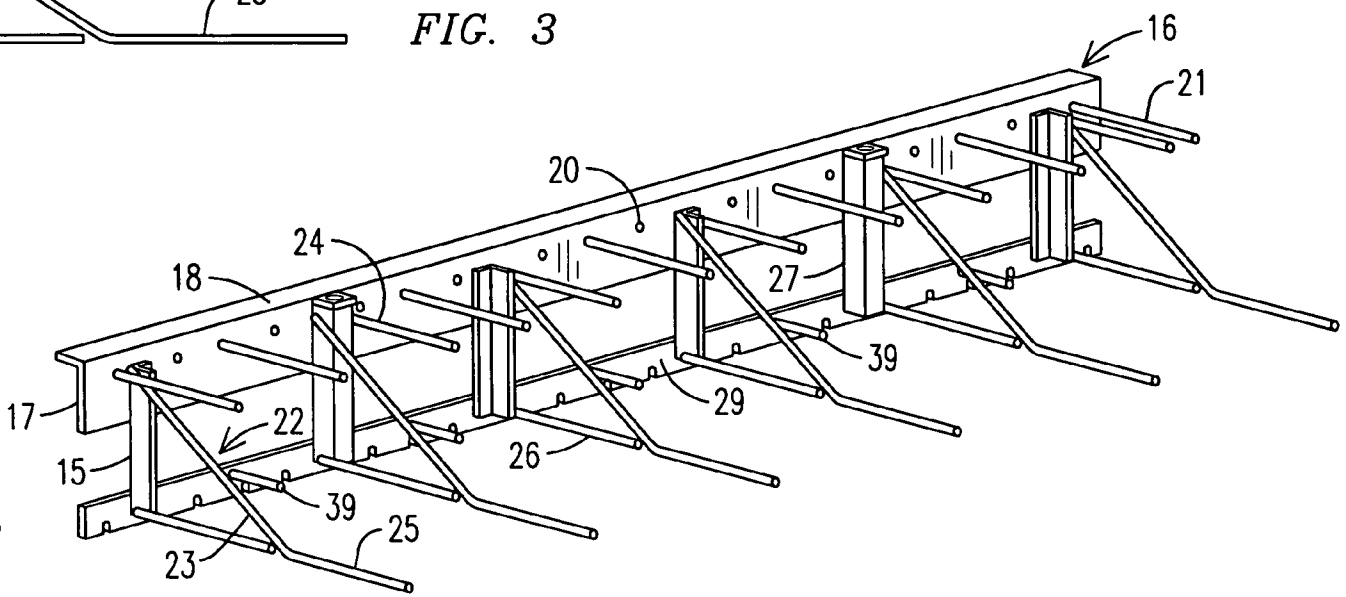
FIG. 2 is a perspective of the end bearing truss of the composite truss of FIG. 1.

The composite truss 10 has an improved load bearing end 13 having a plurality of end members 15 and has a transverse elongated angle steel member 16 fixedly attached to each end member 15, such as by welding, as is more clearly seen in FIG. 2. The transverse angle member 16 has a flat plate 17 that is welded to the end members 15 and has a load supporting flange portion 18. The elongated angle member 16 may be one angled component or may have the flat plate 17 used separately or may have the flat plate 17 and flange 18 welded together. The plate 17 as seem in FIG. 4 has a plurality of apertures 20 therethrough which holes are aligned with the protruding ends of the prestressed strands or tendons that protrude from the upper panel 11. Each end member 15 also has a truss member 22 having a diagonal portion 23 and a horizontal extension 25. Each truss member is fixedly attached to the upper or top end of one end member 15. Each end of each end member 15 is embedded in one of the spaced pair of panels 11 and 12. The truss member 22 has a diagonally extending portion 23 which has one end fixedly attached to the end member 15, such as by welding. The truss member 22 has the elongated horizontal extension 25 which is fully embedded in the lower concrete panel 12. The end bearing truss 13 also includes an elongated rod anchor 26 which has one end welded or fixedly attached to the bottom end of each end member 15. The elongated rod anchor 26 is fully embedded in the lower concrete panel 12. The entire end bearing truss 13 is fully integrated into the composite truss 10 and acts as a unit in mounting the composite truss in a multi-story building to form the floors and ceiling of the building. A plurality of elongated rod anchors 21 may be attached to the plate 17, such as by welding, and extend into the top concrete panel 11. One elongated rod anchors 24 may each be fixedly attached, such as by welding, to the top end of each end member 15 and to each lifting tube 27. The rod anchor 24 may be a length of rebar and extends a short distance, such as 18 inches, into the concrete panel 11. Rod anchors may be made of deformed rebar and may be any length, typically between 12 and 24 inches.

Figure 7:
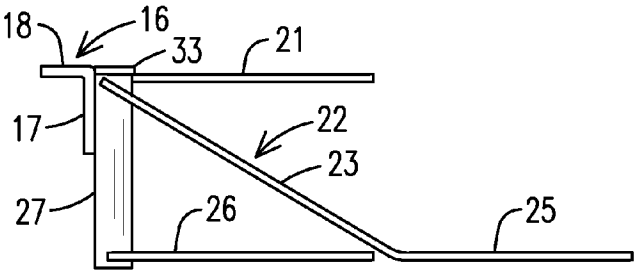
FIG. 7 is a side sectional view of the lift tube having truss rods attached for mounting in the end bearing truss.

The end bearing truss 13 also may be seen to have a pair of lift tubes 27 aligned in a row with the end members 15 and which are also welded to the plate 17 of angle member 16. Any number of lift tubes may be incorporated into the end bearing truss 13 without departing from the spirit and scope of the invention. Each lift tube has a steel generally square cross-section tube and may have a base 30 and a coupling connection 31 having a threaded nut 32 and a cover plate 33. The top plate 33 may be flush with the top concrete panel 11 as seen in FIG. 1 or may be recessed as desired. The lift tube allows the entire dual panel composite truss to be lifted by threadedly coupling a lifting cable thereto. The lift tube 27 is seen in FIG. 7 has the truss member 22 diagonally extending portion 23 fixedly attached to the lift tube 22 tube portion 28, such as by welding. The truss member 22 has an elongated horizontal extension 25 which is fully embedded in the lower concrete panel 12. The end bearing truss 13 also includes an elongated rod 26 which has one end welded or fixedly attached to the bottom end of each tube 28. The elongated rod 26 is fully embedded in the lower concrete panel 12. Elongated rod anchors 21 and 26 are also seen in FIG. 7 along with the angle iron member 16.

Figure 3:
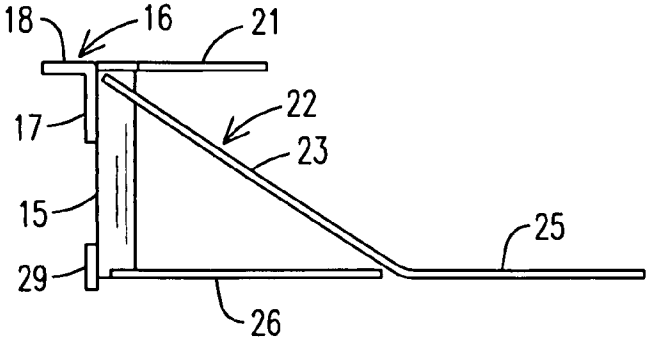
FIG. 3 is a side elevation of the end bearing truss of FIG. 2.
Figure 4:
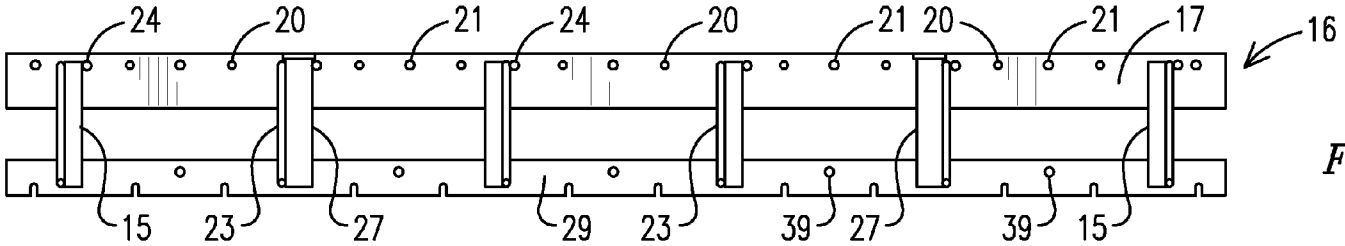
FIG. 4 shows a rear section view of the end bearing truss of FIG. 2.
Figure 6:
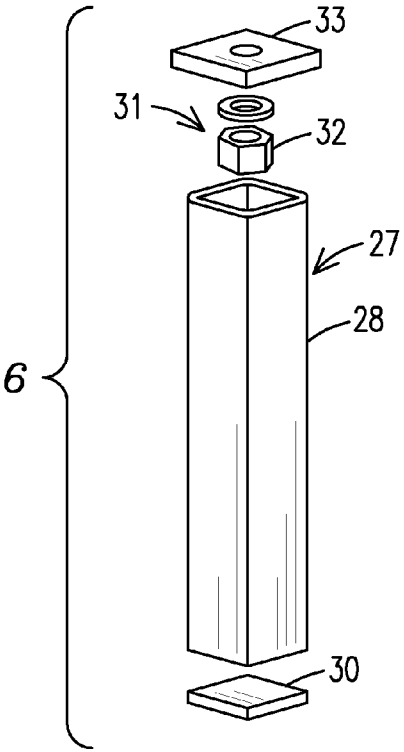
FIG. 6 is an exploded perspective view of the lift tube.

An elongated flat plate 29 may also be fixedly attached to the bottom of the end members 15 and lift tubes 27 as seen in FIGS. 2 and 3. Flat plate 29 has elongated anchor rods 39 attached thereto, such as by welding, and extend into concrete panel 12. This optional flat plate 29 helps align the end members and strengthen the end supporting truss. The flat plate 29 is advantageously positioned to form one end of the concrete form for making the concrete panel 12 when pouring concrete to form the bottom panel 12. Bottom panel 12 is normally poured with the end support truss 13 held in place. Similarly, the elongated flat plate 17 is positioned to act as the end of the concrete form for forming the concrete panel 11. The top panel 11 is normally poured first and the truss turned over to pour the bottom panel 12. The elongated flat plate 17 and the elongated flat plate 29 thus not only form the end of the concrete pouring form but also form an integral part of the end bearing truss.

Figure 5:
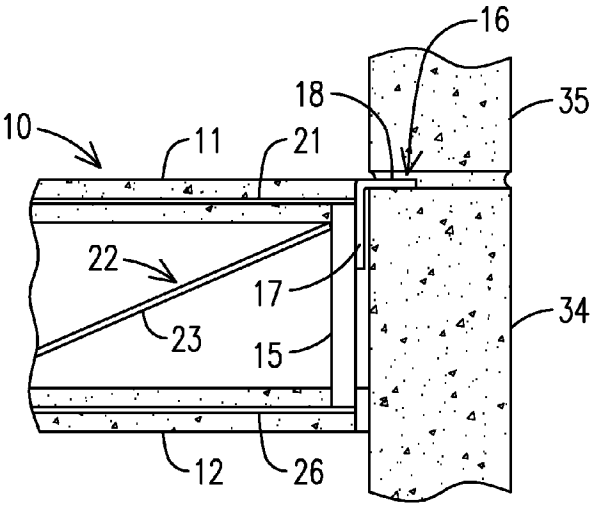
FIG. 5 is a sectional view of the dual panel composite truss installed with the end bearing truss supporting the end of the dual panel composite truss.

The operation of the composite truss end bearing truss is more clearly illustrated in FIG. 5 which has the composite truss mounted in position as the floor or ceiling of a building. A building wall supports one end of a composite truss 10 having concrete panels 11 and 12 forming the floor of a building. The end bearing truss 13 has opposite ends of each end member 15 embedded in the concrete panels 11 and 12 with the diagonal truss member 22 extending from one end of one end member 15 and the elongated rod anchor 26 embedded in the concrete panel 12. A prestressed strand for prestressing the concrete has ends protruding from the concrete panels 11 and 12 which may extend into apertures 20 in the elongated flat member 17 from panel 11. The transverse angle member 16 has the elongated plate 17 welded to each end member 15 and has the flange plate 18 resting on a concrete wall 34 ledge which has the next floor wall 35 mounted thereover. The composite truss 10 is being used as a floor of a multi-story building and can be delivered to a site under construction and put in place without requiring ledges, corbels or other supporting features which would otherwise complicate the design and encroach on the finishing spaces.

Figure 10:
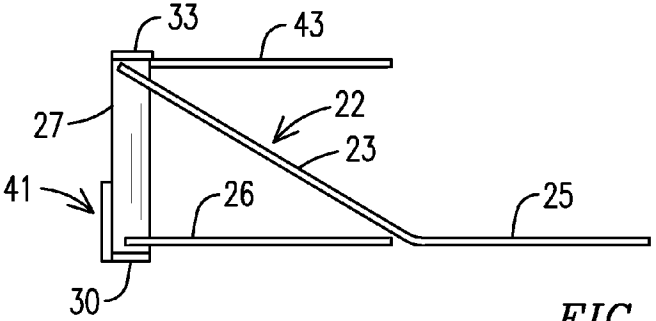
FIG. 10 is a side sectional view of the mounted end bearing truss in accordance with FIGS. 8 and 9.
Figure 8:
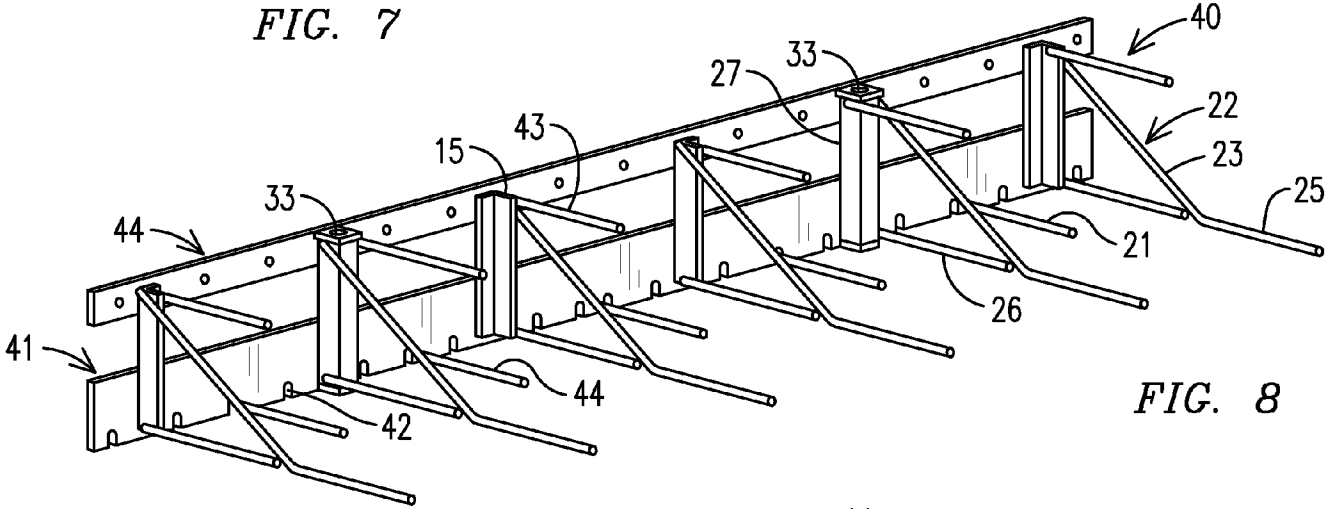
FIG. 8 is a perspective view of an alternate embodiment of the end bearing truss.
Figure 9:
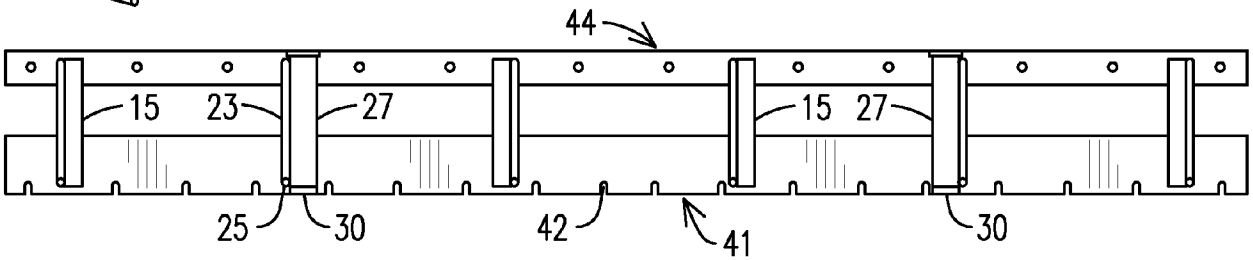
FIG. 9 is a rear sectional view of the end bearing truss of FIG. 8.

FIGS. 8, 9 and 10 illustrate a second embodiment of a composite truss 10 having an end bearing truss 40. The end bearing truss 40 has a plurality of end members 15 and lift tubes 27 aligned in a row and has an elongated flat plate 41 fixedly attached to the bottom end thereof, such as by being welding to each end member 15 and lift tube 27. The flat plate 41 has a plurality of notches 42 in the bottom thereof for receiving the end of the prestress strands or tendons. The flat plate is seen as mounted to the bottom of the row of end members 15 in this embodiment. The end bearing truss 40 has one end of each end member 15 embedded in the concrete panels 11 and the other end embedded in panel 12. Each end member 15 also has a truss member 22 fixedly attached to the upper or top end of each end member 15. Each end of each end member 15 is embedded in one of the pair of panels 11 and 12. Each truss member 22 has a diagonally extending portion 23 which has one end fixedly attached to the end member 15, such as by welding. The truss member 22 has an elongated horizontal extension 25 which is fully embedded in the lower concrete panel 12. The end bearing truss 40 also includes the elongated rod anchors 26 welded or fixedly attached to the bottom end of each end member 15. Each elongated rod anchor 26 is fully embedded in the lower concrete panel 12. A second elongated rod anchor 43 has one end welded or fixedly attached to the top end of each end member 15 and fully embedded in the top concrete panel 11. A plurality of elongated rod anchors 44 are each welded at one end to the elongated flat plate 41. Each elongated rod anchor may be made of deformed rebar and may be any length desired such as between 12 to 24 inches and is embedded in the lower concrete panel 12. End bearing truss 40 may also have an elongated flat plate attached to the top of end members 15 and lift tubes 27 as seen in FIGS. 8 and 9. This plate helps align the end members and strengthens the end supporting truss 40. It also is positioned to form one end of the concrete form for making concrete panel 11.

It should be clear at this time that a dual panel composite truss having a pair of spaced apart concrete panels having an improved end bearing truss has been provided. However the present invention is not to be considered limited to the forms shown which are to be considered illustrative rather than restrictive.

We claim:

1. A composite truss comprising:

a main truss having a pair of spaced apart concrete panels spaced by a plurality of generally vertical members, each end of each generally vertical member being embedded in opposite spaced apart concrete panels, said truss having a plurality of diagonal members each extending between said pair of spaced apart concrete panels; and an end bearing truss having:

a plurality of end members aligned along one end of said spaced apart panels, each end member having two end portions and each end member having one end portion thereof embedded in one concrete panel and the other end portion thereof embedded in the other concrete panel;

a plurality of diagonal truss members, each diagonal truss member having a generally horizontal end extension extending therefrom, each said diagonal truss member being fixedly attached to one end of one said end member and having the generally horizontal extension therefrom embedded in one concrete panel;

a least one elongated rod anchor fixedly attached to each of a plurality of end members and extending therefrom and embedded in one of said concrete panels; and a transverse extending angle member having a pair of elongated sides generally at right angles to each other, one said elongated side of said angle member being fixedly attached to each of a plurality of said aligned end members adjacent one of said concrete panels with the other elongated side forming a supporting flange for said main truss;

whereby a dual panel composite truss has a main truss having a load supporting end bearing truss formed on the end thereof.

2. The composite truss in accordance with claim 1 in which said end bearing truss has an elongated rod anchor fixedly attached to and extending from each end of each of a plurality of said end members, each said elongated rod anchor being embedded in the concrete panel adjacent thereto.

3. The composite truss in accordance with claim 2 in which each said end bearing truss elongated rod anchor is welded to one said end member.

4. The composite truss in accordance with claim 3 including a plurality of elongated rod anchor fixedly attached to and extending from said elongated transverse angle member, each said elongated rod anchor being embedded in the concrete panel adjacent thereto.

5. The composite truss in accordance with claim 1 in which said transverse extending angle member is fixedly attached to each of a plurality of said aligned end members to form one end of a concrete form used in forming the one said concrete panel.

6. The composite truss in accordance with claim 5 including an elongated flat plate fixedly attached to each of a plurality of said aligned end members adjacent the other of said concrete panels.

7. The composite truss in accordance with claim 6 in which said elongated flat plate has a plurality of elongated rod anchors fixedly attached thereto and extending therefrom into the other of said concrete panels.

8. The composite truss in accordance with claim 5 in which said elongated flat plate is fixedly attached to each of a plurality of said aligned end members to form one end of the concrete form used in forming the other said concrete panel.

9. The composite truss in accordance with claim 5 in which said transverse extending angle member has a plurality of apertures therein, each aperture having a prestressed strand end from said one panel extending thereinto.

10. The composite truss in accordance with claim 9 in which said elongated flat plate has a plurality of notches therein, each notch having a prestressed strand end from said other panel extending thereinto.

11. The composite truss in accordance with claim 1 in which said end bearing truss has a lift tube therein aligned with said plurality of end members, said lift tube having two ends and having one end extending through one said concrete panel, said one end having a coupling connection thereon.

12. The composite truss in accordance with claim 11 in which said lift tube coupling connection includes a threaded connection.

13. The composite truss in accordance with claim 12 in which said end bearing supporting truss has a plurality of said lift tubes therein.

14. The composite truss in accordance with claim 13 in which said transverse extending angle member one said elongated side is welded to each of said plurality of end members and to each said lift tube.

15. The composite truss in accordance with claim 13 in which each said end bearing truss elongated rod extending from each end of each end member is welded to said end member.

16. The composite truss in accordance with claim 15 in which said end bearing truss plurality of end members are steel members.

17. A composite truss comprising:

a main truss having a pair of spaced apart prestressed concrete panels spaced by a plurality of vertical members, each end of each vertical member being embedded in opposite spaced concrete panels, and a plurality of diagonal members each extending between a pair of vertical members;

an end bearing truss having:

a plurality of end members aligned along one end of said spaced apart panels, each end member having two end portions and each end member having one end portion thereof embedded in one concrete panel and the other end portion thereof embedded in the other concrete panel;

a plurality of diagonal truss members, each diagonal truss member having a generally horizontal end extension extending therefrom, each said diagonal truss member being fixedly attached to one end of one said end member, and having the generally horizontal extension therefrom embedded in one concrete panel;

a least one elongated rod anchor fixedly attached to each of a plurality of end members and extending therefrom and embedded in one of said concrete panels; and a transverse extending elongated plate fixedly attached to said aligned end members adjacent one of said concrete panels;

whereby a dual panel composite truss has a main truss having a load supporting end bearing truss formed onto the end thereof.

18. The composite truss in accordance with claim 17 in which said end bearing truss has an elongated rod fixedly attached to and extending from each end of each end member and each elongated rod being embedded in the concrete panel adjacent thereto.

19. The composite truss in accordance with claim 18 having an elongated supporting flange fixedly attached to and extending from said transverse elongated flat plate.

20. The composite truss in accordance with claim 18 in which said transverse extending elongated plate has a plurality of notches therein, each notch having a prestressed strand end extending thereinto.

21. The composite truss in accordance with claim 18 in which said end bearing truss includes a lift tube therein aligned with said plurality of end members and fixedly attached to said elongated flat plate, said lift tube having two ends and having one end extending through one said concrete panel, said one end having a coupling connection thereon.

22. The composite truss in accordance with claim 21 in which said lift tube coupling connection includes a threaded connection.

23. The composite truss in accordance with claim 22 in which said end supporting truss has a plurality of said lift tubes therein.

24. The composite truss in accordance with claim 18 in which said transverse extending elongated flat plate is welded to each of said plurality of end members and to each said lift tube.

25. The composite truss in accordance with claim 18 in which each said end bearing truss elongated flat plate is fixedly attached to each of a plurality of said aligned end members in a position to form one end of the concrete form used in forming one of said concrete panels.

* * * * *